United States Patent [19]

Takagi et al.

[11] Patent Number: 4,906,891

[45] Date of Patent: Mar. 6, 1990

[54] LOW-PRESSURE DISCHARGE LAMP AND ELECTRICAL BASE STRUCTURE

[75] Inventors: Masami Takagi, Yokohama; Shinichi Tsunekawa, Fujisawa; Kenji Ohkubo, Kawasaki, all of Japan

[73] Assignee: Kabushiki Kaisha Toshiba, Kawasaki, Japan

[21] Appl. No.: 197,959

[22] Filed: May 24, 1988

[30] Foreign Application Priority Data

May 25, 1987 [JP] Japan ..... 62-77335[U]

[51] Int. Cl.[4] ..... H01J 61/30; H01J 5/52

[52] U.S. Cl. ..... 313/318; 313/51; 313/493; 439/226; 439/239; 439/612; 439/619

[58] Field of Search ..... 313/318, 493, 51; 439/612, 619, 226, 227, 228, 229, 232, 239

[56] References Cited

U.S. PATENT DOCUMENTS 2,216,223 10/1940 Bergmans et al. ..... 439/612
3,602,755 8/1971 Hoeh ..... 313/493

FOREIGN PATENT DOCUMENTS 38-443 1/1938 Japan .
60-130440 8/1985 Japan .
62-12255 1/1987 Japan .

*Primary Examiner*—Palmer C. DeMeo
*Attorney, Agent, or Firm*—Cushman, Darby & Cushman

[57] ABSTRACT

A low-pressure discharge lamp includes a bulb and a pair of bases attached to the end portions of the bulb, respectively. Each base has a base body fixed to the end of the bulb and a pair of terminals attached to the periphery of the base body. The terminals have contact portions which project from the periphery of the base body and include contact surfaces extending parallel to the axis of the bulb and facing the same direction. The contact surfaces are located so as to contact a common plane.

20 Claims, 7 Drawing Sheets

LOW-PRESSURE DISCHARGE LAMP AND ELECTRICAL BASE STRUCTURE

BACKGROUND OF THE INVENTION

1. Field of the Invention

The present invention relates to a low-pressure discharge lamp such as a fluorescent lamp, a cold-cathode discharge lamp, or a glow lamp.

2. Description of the Related Art

Recently, low-pressure discharge lamps of the type which have two terminals extending from each base, at right angles to the axis of the bulb, have been used in place of low-pressure discharge lamps of the conventional type which have two terminals extending from each base, parallel to the axis of the bulb. Such a low-discharge lamp is disclosed in Japanese Utility Model Disclosure No. 62-12255. This discharge lamp is characterized in that the two terminals extending from either base take positions symmetrical with respect to the axis of the bulb, and extend from the base in opposite directions.

The discharge lamp of the type described above can be shorter than in the conventional type lamp, since the terminals extend from the bases perpendicular to the axis of the bulb. Further, since the sockets to which the terminals are to be connected can be located at the side of the bases, the lamp device including both the lamp and these sockets can be shorter than otherwise. Moreover, even if the discharge lamp is slightly shorter or longer than it should be, the terminals can, nonetheless, be electrically connected to the sockets.

As has been pointed out, the two terminals extending from either base take positions symmetrical with respect to the axis of the bulb and extend in opposite directions. Therefore, the two power-supply terminals of the socket, which are to be connected with the terminals of the base, must be located on the opposite side of the base. The width of the socket, i.e., the dimension of the socket, along the diameter of the base, is inevitably great. Further, to connect the lamp with the sockets, the lamp must be so moved to have both bases inserted in the sockets, and must also be rotated around its axis so as to adjust the rotational position of the lamp. This is a rather complex manual operation.

Furthermore, if the bases are attached to the ends of the bulb, with the terminals of the first base positioned out of alignment with those of the second base, the terminals of one of the bases may not be electrically connected to the socket, though the terminals of the other base are electrically coupled to the corresponding socket.

SUMMARY OF THE INVENTION

It is accordingly the object of the present invention to provide a low-pressure discharge lamp which is short, has a longer light-emitting portion than a conventional lamp of the same length, can be connected to smaller sockets, and can be easily and securely coupled to, and easily disconnected from, the sockets.

Another object of the present invention is to provide a low-pressure discharge lamp comprising a bulb and a pair of bases attached to the ends of the bulb, each having terminals located in alignment with the terminals of the other base.

To achieve this object, a low-pressure discharge lamp according to the present invention comprises a bulb having two end portions and electrodes contained in the end portions and a pair of bases. Each of the bases has a base body which is attached to the end portion of the bulb and has a periphery substantially parallel to an axis of the bulb, and a pair of terminals fastened to the periphery of the base body side by side. The terminals have contact surfaces which extend in a direction substantially parallel to the axis of the bulb.

Further, according to the invention, the periphery of each base body includes a flat surface portion, and both terminals are attached to the flat surface portion so that the contact surfaces of the terminals contact a common plane.

Since neither terminal attached to either base body projects from the base body in a direction parallel to the axis of the bulb, the lamp is shorter than otherwise. In addition, since the contact surfaces of both terminals attached to the base body are located on one side of the plane including the axis of the bulb, the power-supply terminals of a socket, with which the terminals are to be connected, can be placed on one side of the base body. Hence, the width of the socket, i.e., the dimension along the diameter of the bulb, can be smaller than in the conventional lamp. Moreover, the base can be attached to or detached from the socket by pushing or pulling the base in one direction without rotating it. Therefore attaching and detaching operations of the base are easier than in the conventional lamp.

BRIEF DESCRIPTION OF THE DRAWINGS

FIGS. 1 to 8 show a fluorescent lamp according to an embodiment of the present invention, in which FIG. 1 is a perspective view of the lamp, FIG. 2 is a sectional view of the lamp, taken along line II—II in FIG. 1, FIG. 3 is a sectional view of the lamp, taken along line III—III in FIG. 1;

FIG. 4 is a sectional view of the lamp, taken along line IV—IV in FIG. 1;

FIG. 5 is a front view of a base attached to one end of the bulb of the lamp, FIG. 6 is a bottom view of the base, FIG. 7 is a perspective view of one of the terminals attached to the base; and FIG. 8 is a sectional view of the base, taken along line VIII—VIII in FIG. 3;

DETAILED DESCRIPTION OF THE PREFERRED EMBODIMENTS

Figure 1:
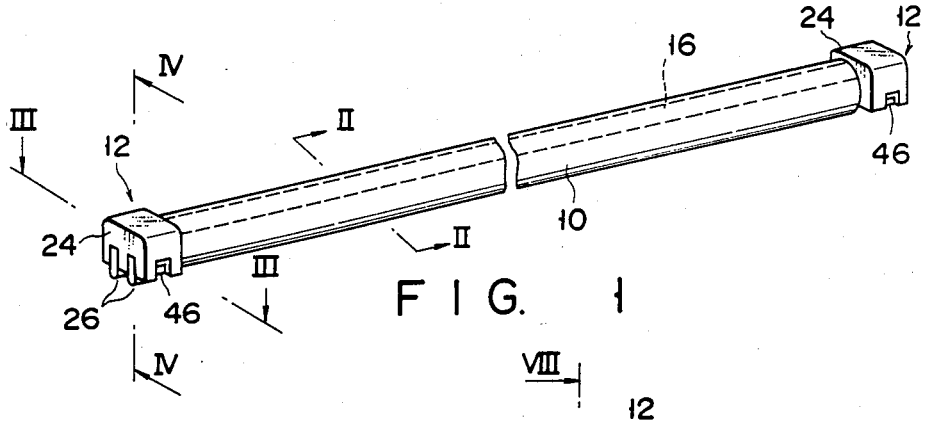
Figure 2:
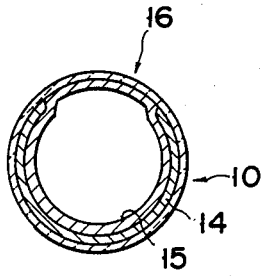

Embodiments of the present invention will now be described with reference to the accompanying drawings.

FIGS. 1 to 8 illustrate a straight fluorescent lamp according to one embodiment of the present invention. As is shown in FIGS. 1 to 4, this fluorescent lamp comprises a straight cylindrical bulb 10 and two bases 12 fixed to the ends of bulb 10. The inner circumference of bulb 10 is coated with reflector layer 15, except for a predetermined elongated portion 16 which extends parallel to the axis of bulb 10, as can be understood from FIG. 2. Phosphor layer 14 is formed on reflector layer 15 and also on portion 16 of the inner circumference of bulb 10. Portion 16, through which light can be emitted from bulb 10, constitutes a light-emitting portion. The fluorescent lamp is, therefore, a so-called aperture-type one which emits light through an elongated portion of bulb 10.

Each end of bulb 10 is sealed with flared stem 18. A pair of leads 20 air-tightly penetrate stem 18. Filament electrode 22 is connected between those end portions of leads 20 which are located within bulb 10. A predetermined amount of mercury vapor, and a predetermined amount of a rare gas are sealed within bulb 10.

As is shown in FIG. 1 through FIG. 7, either base 12 fixed to the end of bulb 10 comprises base body 24 made of electrically insulative material such as a synthetic resin, and a pair of power-input terminals 26 attached to base body 24. Base body 24 is shaped like a prism, and has bottomed hole 28 coaxial with bulb 10. Base body 24 is fastened to bulb 10, with the end portion of bulb 10 fitted in bottomed hole 28. Bottom wall 24*a* of body 24 is flat, and the axis of bulb 10 is perpendicular to this bottom wall 24*a*. The periphery of base body 24, i.e., the side surfaces of base body extend parallel to the axis of bulb 10.

Two parallel fitting grooves 30 are formed in the outer surface of bottom wall 24*a*, i.e., the end surface of base body 24. These grooves 30 vertically extend from one side edge of bottom wall 24*a* to the middle part of the bottom wall. Two support grooves 32 are cut in one side surface of base body 24. Support grooves 32 are continuous to grooves 30, respectively, and extend parallel to the axis of bulb 10. As can be clearly seen from FIG. 8, each support groove 32 has a T-shaped cross section; its opening portion is narrower than its bottom portion.

Figure 6:
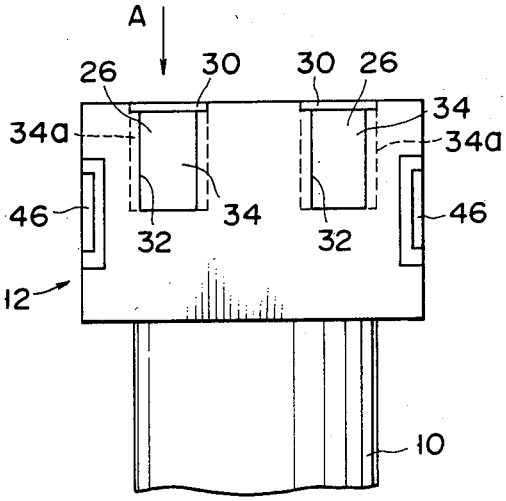
Figure 7:
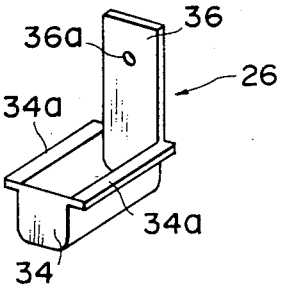

As is evident from FIG. 7, either power-input terminal 26 is made by deep-drawing an electrically conductive plate. It comprises trough-shaped contact portion 34, and connector portion 36 extending at right angles from one end of contact portion 34. Contact portion 34 has two flanges 34*a* which are formed integrally with the lateral rims of the trough-shaped portion. Connector portion 36 has through-hole 36*a*. Either terminal 26 is secured to base body 24, with contact portion 34 fitted in support groove 32 of base body 24. More specifically, as is illustrated in FIG. 6, portion 34 is pushed down in the direction of arrow A so that flanges 34*a* are fit into the wider portion of support groove 32. When contact portion 34 is pushed down into groove 32, the connector portion 36 of terminal 26 is fitted into groove 30 of base body 24.

Contact portions 34, both attached to base body 24, protrude from the side surface of base body 24, in the same direction, i.e., in a direction perpendicular to the side surface. The bottom surface 34*a* of either contact portion 34 constitutes a contact surface which is to contact with the power-supply terminal of a socket (which will be described later). Bottom surfaces 34*a* of both contact portions 34 extend parallel to each other, along the axis of bulb 10. Further, surfaces 34*a* are substantially in the same plane. Either contact portion 34 has a height less than the length of the contact surface. As is shown in FIG. 8, the contact surfaces of either pair of terminals 26 are located between two parallel planes B contacting the periphery of base body 24, and located below plane C which intersects with planes B at right angles and includes the axis of bulb 10.

Figure 3:
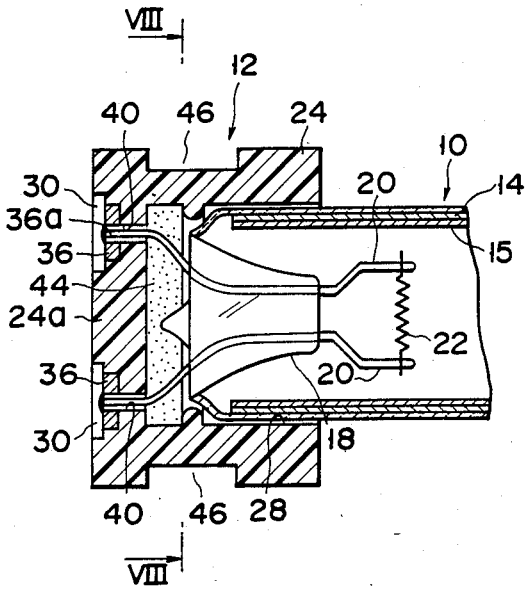
Figure 4:
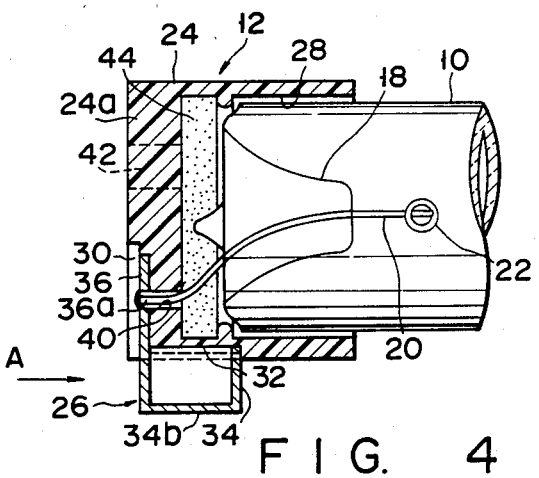

As is illustrated in FIGS. 3 and 4, two through holes 40 are cut in bottom wall 24*a* of either base body 24. These holes 40 are coaxial with holes 36*a* cut in connector portions 36 of terminals 26. The outer end portion of each lead 20, which projects from the end of bulb 10, passes through holes 40 and 36*a*, and is soldered to connector portion 36 of terminal 26. Hence, each contact portion 34, which is integral with connector portion 36, is electrically connected to filament electrode 22 by means of connector portion 36 and lead 20. Relatively large hole 42 is formed in bottom wall 24*a* of either base body 24. This hole 42 extends parallel to the axis of bulb 10. After the end portion of bulb 10 has been inserted into hole 28 of base body 24, and leads 20 have been soldered to connector portions 36 of terminals 26, adhesive 44 is pored into hole 28 via hole 42, whereby base 12 is firmly adhered to the end of bulb 10.

Figure 5:
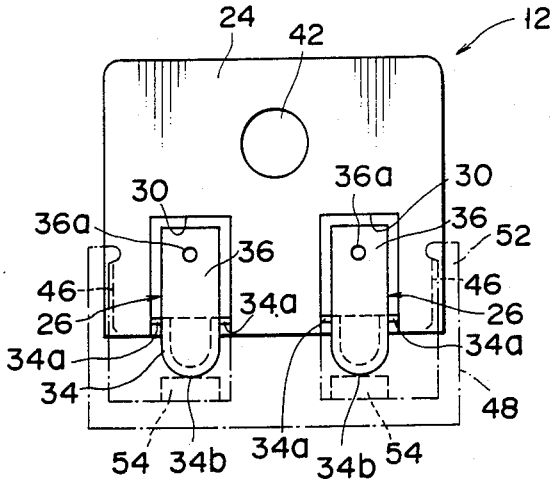

As is shown in FIGS. 1, 3, and 5, two grooves 46 are formed in the vertical side surfaces (FIG. 8) of base body 24. These grooves 46 extend at right angles to the axis of bulb 10, and one end of each groove 46 opens to that side surface of base body 24 on which contact portions 34 of terminals 26 are attached.

Figure 8:
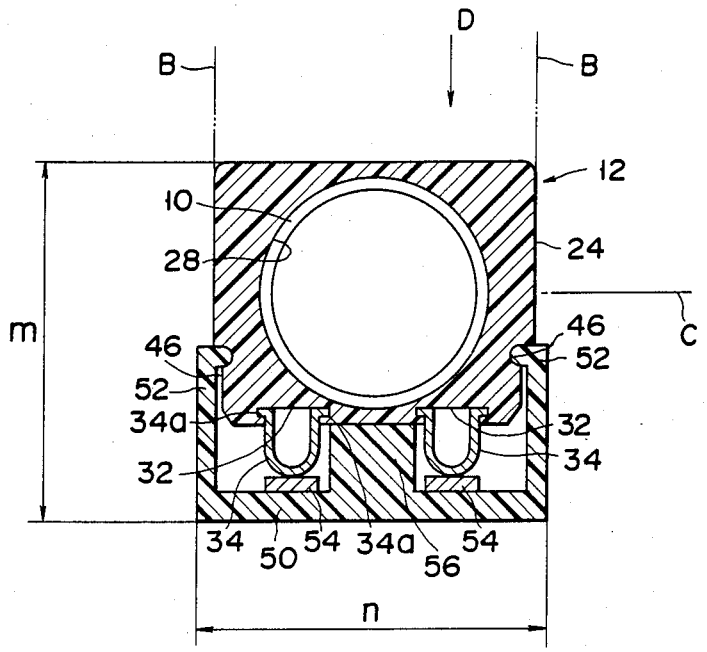

FIG. 8 shows socket 48 to which base 12 is connected. As is shown in this figure, socket 48 comprises flat base 50 and a pair of claws 52 which extend from base 50 in parallel to each other and perpendicular to base 50. These claws are to fit into grooves 46 of base body 24. Claws 46 are spaced apart a distance slightly shorter than the width of base body 24, and can resiliently bend toward and away from each other. A pair of strip-like power-supply terminals 54 are attached to the upper surface of base 50, set apart from each other for a predetermined distance. Stopper 56, which is integrally formed with base 50, protrudes upward from the upper surface of base 50, and is located between power-supply terminals 54. Terminals 54 can be connected to terminals 26 of base 12 as is shown in FIG. 8. Stopper 56 is to abut the lower surface of base body 24 as is illustrated in FIG. 8.

When base 12 is pushed into socket 48 in the direction of arrow D (FIG. 8), with both terminals 26 set opposite to power-supply terminals 54, both claws 52 snap into grooves 46 cut in base body 24, and the contact surfaces of terminals 26 contact power-supply terminals 54. At the same time, the lower surface of base body 24 touches stopper 56, whereby base 12 can not be pushed any further into socket 48. Thus, base 12 is connected to socket 48. When both bases 12 are fit to the corresponding sockets, the fluorescent lamp is mechanically supported by the sockets. In this condition, both filament electrodes 22 are connected to a power supply (not shown) because terminals 26 of either base 12 are in contact with the power-supply terminals 54 of socket 48.

As has been described above, according to the fluorescent lamp, the connector portions 34 of power-input terminals 26 do not project from base body 24 in the axial direction of bulb 10. Rather, they extend at right angles to the axis of bulb 10. Therefore, the fluorescent lamp is shorter than in the case where contact portions 34 project from base body 24 in the axial direction of bulb 10. It follows that the lamp can have an effective light emitting length longer than that of the conventional lamp having the same lamp length, which has power-input terminals protruding from either base in the axial direction of the bulb.

Also, two terminals 26 attached to either base body 24 are located between a pair of parallel planes B which contact the side surfaces of base body 24, and also below plane C intersecting at right angles with planes B and including the axis of bulb 10. Hence, it suffices to place socket 48 on only one side of base body 24, i.e., the lower side of base body 24, in order to connect power-supply terminals 54 with terminals 26 of base 12. Therefore, the width n and height m of the unit comprised of base 12 and socket 48 can be smaller than in the conventional case wherein the lamp has a pair of power-input terminals extending from the base body in the opposite directions and the power-supply terminals of the socket are located at both sides of the base.

In order to attach either base 12 to socket 48, it suffices to push the base into the socket in the direction of arrow D, as is illustrated in FIG. 8. To detach base 12 from socket 48, it suffices to pull base 12 in the opposite direction, out of the socket. The lamp need not be rotated about its axis in order to be attached to, or detached from, the sockets and in order to adjust the positions of terminals 26 relative to the power-supply terminals of the socket, unlike the conventional lamp. Obviously, the lamp according to this embodiment is easier than the conventional one to attach to, or detach from the sockets.

As has been explained, the contact surfaces of power-input terminals 26 extend parallel to the axis of bulb 10. Thus, even if the lamp is slightly shorter or longer than it should be, both terminals 26 can be securely connected to power-supply terminals 54 of socket 48. Further, since contact portions 34 of terminals 26 projects at right angles to the axis of bulb 10, base 12 takes a specific position with respect to socket 48 when it is attached to socket 48. Thus, when the lamp is attached to sockets 48, the light-emitting portion 16 of bulb 10 is automatically and accurately located so as to emit light in a desired direction, provided that light-emitting portion 16 has been set in a specific positional relation with both bases 12.

Further, in this embodiment, both terminals 26 are fixed to the flat side surface of base body 24, and the contact surfaces of the terminals are in the same plane. Thus, when either base 12 is fit to socket 48, it is stably held on the socket without rotating around the axis of bulb 10.

Also, each terminal 26 has connector portion 36 which is attached to bottom wall **24*a* of base body 24 and has hole 36*a*. Hole 36*a* is coaxial with hole 40 cut in bottom wall 24*a* and opposes the outer end of lead 20. Lead 20 can, therefore, be connected to terminal 26, merely by passing the outer end portion of lead 20 first through hole 40 and then though hole 36*a*, and by soldering lead 20 to connector portion 36. Furthermore, either base 12 can be fastened to the end of bulb 10, merely by injecting adhesive 44 into the gap between bulb 10 and bottom wall 24*a* through hole 42 made in the bottom wall of base body 24**.

As has been described above, the contact surfaces of both terminals 26 of either base 12 are in the same plane. Hence, if both bases 12 are fit to the ends of bulb 10, respectively, then adhesive 44 is injected into the gap between bulb 10 and either base 12, and finally the terminals of either base 12 are placed on a flat table, bases 12 will be secured to bulb 10, with terminals of the first base located in alignment with the terminals of the second base. Accordingly, terminals 26 of either base 12 can be securely connected to the terminals of the socket.

The present invention is not limited to the embodiment described above. Various changes and modifications can be made within the scope of the invention.

Figure 9:
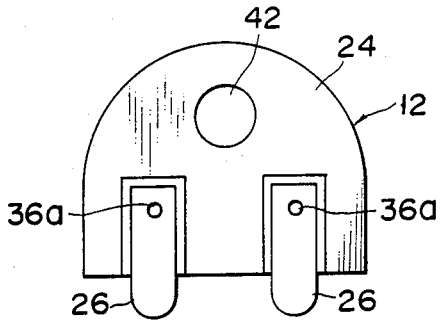
FIG. 9 is a front view of a modification of the base.
Figure 10:
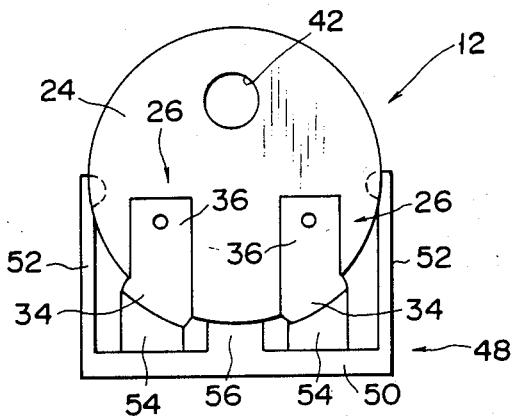
FIG. 10 is a front view of another modification of the base.

For example, can body 24 need not be a prism; it can be a member having a semicircular cross section as is shown in FIG. 9, or a hollow cylinder as is illustrated in FIG. 10. In either alternative case, power-input terminals 26 must be positioned in the same way as in the first embodiment shown in FIG. 1 through FIG. 8.

In the modification shown in FIG. 10, the bottom surface of contact portion 34 of either terminal 26, i.e., the contact surface of terminal 26 is curved along the outer circumference of base body 24. Power-supply terminals 54 of socket 48 have upper, curved surfaces which are complementary to the curved contact surfaces of terminals 26.

Figure 11:
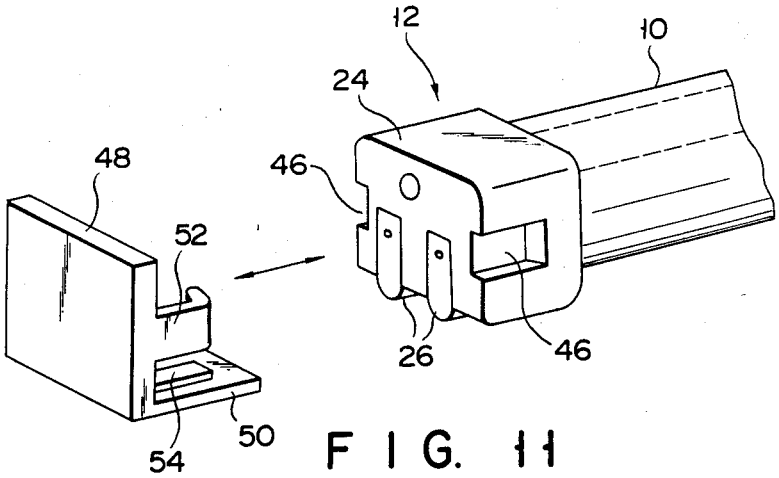
FIG. 11 is a perspective view showing a further modification of the base.

Moreover, as is shown in FIG. 11, grooves 46 of base body 24 can extend from the outer end-surface of base body 24 and parallel to the axis of bulb 10. If this is the case, claws 52 of socket 48 extend parallel to terminals 54, and base 12 is attached to, or detached from, socket 48, by moving the lamp in its axial direction.

Figure 12:
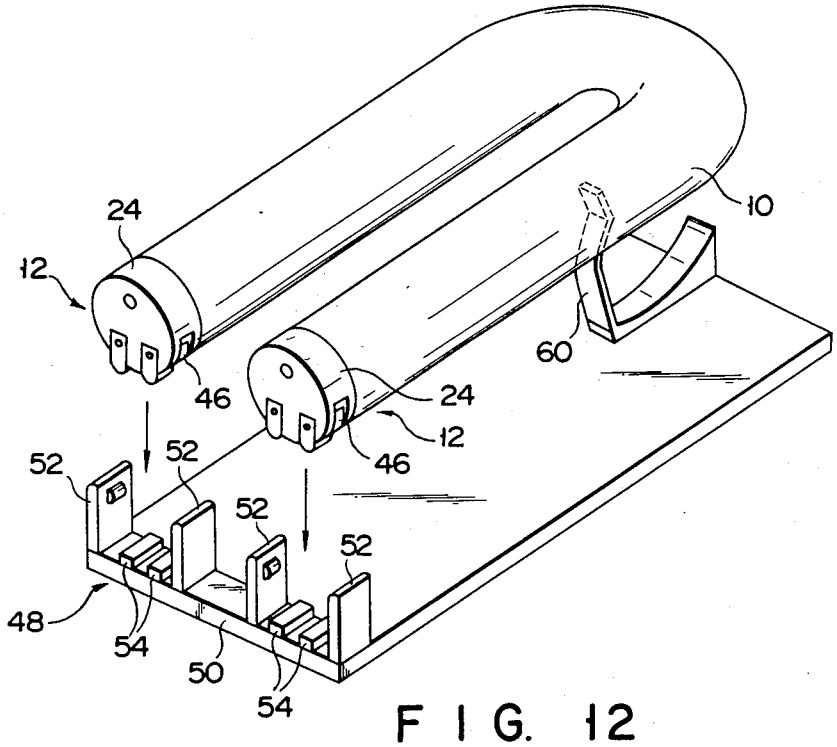
FIG. 12 is a perspective view of a lamp according to a second embodiment of the invention.

The present invention can apply not only to a fluorescent lamp, but also to other low-pressure discharge lamps such as a cold-cathode discharge lamp and a glow lamp. Further, it can apply not only to an aperture-type lamp, but also to the ordinary types of low-pressure discharge lamps. Still further, the invention can apply not only to a lamp having a straight bulb, but also to a lamp having such a U-shaped bulb as is shown in FIG. 12. In the embodiment of FIG. 12, too, the power-input terminals are located on one side of the plane including the axis of bulb 10. The lamp shown in FIG. 12 has the same advantages as the first embodiment described above. In FIG. 12, numeral 60 represents a leaf spring for holding the curved portion of bulb 10. Moreover, the present invention can apply to a low-pressure discharge lamp having a bulb of any other shape, provided both end portions are juxtaposed. Therefore, the invention can apply to a lamp having a W-shaped bulb, too.

Figure 13:
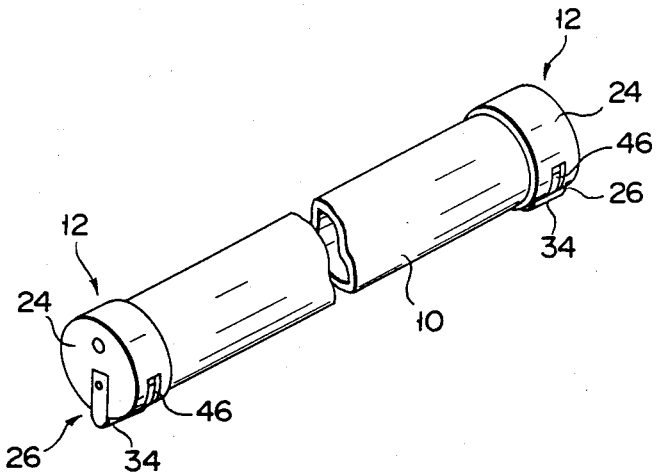
FIGS. 13 and 14 are perspective views showing third and fourth embodiments of the present invention.
Figure 14:
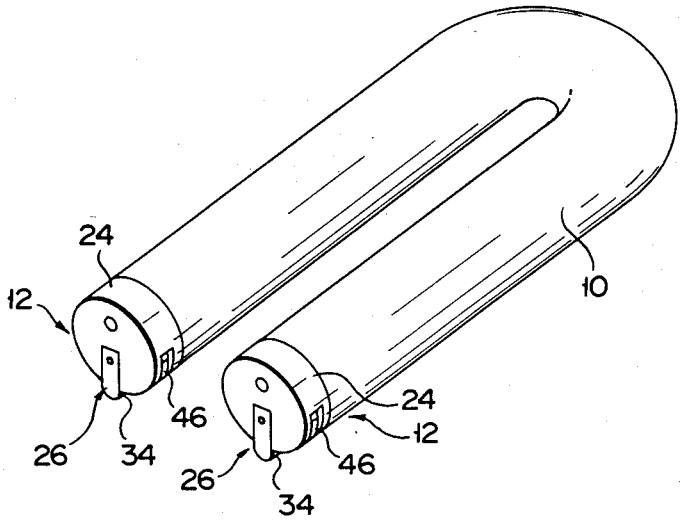

The present invention also can apply to low-pressure discharge lamps as are shown in FIGS. 13 and 14, wherein each base 12 includes only one terminal 26. In either lamp, contact portions 34 of both terminals 26 project from base bodies 24 in the same direction.

Figure 15:
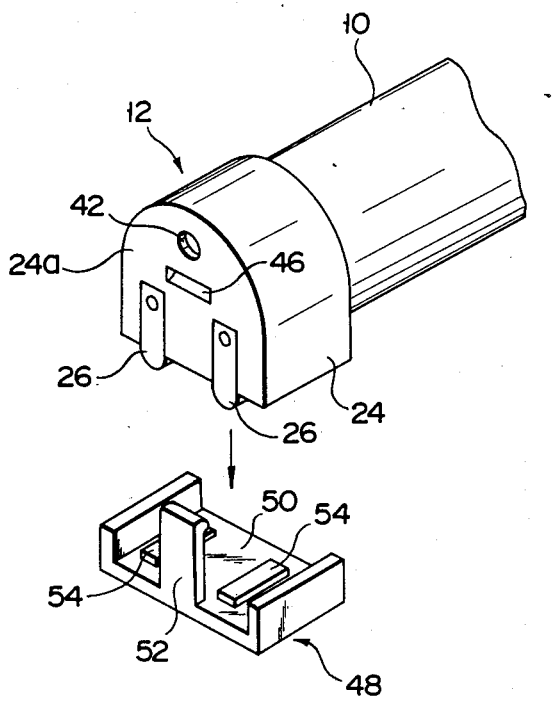
FIG. 15 is a perspective view showing another modification of the base and socket.

Further, as is shown in FIG. 15, base body 24 may have groove 46 formed in the outer surface of bottom wall **24*a*. In this case, socket 48 includes a single claw 52 perpendicularly extending from base 50 to face bottom wall 24*a* of base 12. When base 12 is pushed into socket 48, claw 46 snap into groove 46 of base 12**, thereby holding it.

Flared stems 18, both incorporated within bulb 10, can be replaced by button-type stems. A button-type stem is a flat plate, and does not protrude so deep into the bulb as flared step 18. Thus, when button-type stems are used in place of flared stems 18, the distance between either end of bulb 10 and filament electrode 22 can be shorter. Hence, a lamp having button-type stems can have an effective light-emitting length longer than that of the lamp which has the same length and is provided with flared stems.

What is claimed is:

1. A low-pressure discharge lamp comprising:

a bulb having two end portions, an electrode contained in each end portion of said bulb; and a base fitted at each of the end portions of said bulb, each base having a base body the periphery of said base body having a flat surface portion, and a pair of terminals connected to said electrode and attached to the flat surface portion, said terminals having contact surfaces which extend substantially parallel to the axis of the bulb and are to be connected to power supply means.

2. A low-pressure discharge lamp according to claim 1, wherein said pair of terminals are located between two parallel planes contacting the periphery of said base body, and located on one side of the plane intersecting at right angles with the parallel planes and including the axis of the bulb.

3. A low-pressure discharge lamp according to claim 1, wherein each of said terminals has a contact portion which projects from the peripheral surface of the base body and has said contact surface.

4. A low-pressure discharge lamp according to claim 3, wherein said contact portion of each terminal has a height less than the length of the contact surface.

5. A low-pressure discharge lamp according to claim 4, wherein said contact portion of each terminal is shaped like a trough and said contact surface is constituted by the bottom surface of the contact portion.

6. A low-pressure discharge lamp according to claim 3, wherein said base body has two support grooves formed in the periphery and extending parallel to the axis of said bulb, and the contact portions of said terminals are fitted in the support grooves.

7. A low-pressure discharge lamp according to claim 6, wherein said base body includes an end wall located perpendicular to the axis of the bulb, each of said terminals has a connector portion which extends from the contact portion and is attached to the end wall, and each of said electrodes has a pair of leads which extend outwardly from the end of the bulb and are connected to the corresponding connector portions.

8. A low-pressure discharge lamp according to claim 7, wherein said base body has a pair of grooves formed in the outer surface of the end wall, and said connector portions are fitted in these grooves.

9. A low-pressure discharge lamp according to claim 1, wherein said contact surfaces of the terminals are directed in the same direction.

10. A low-pressure discharge lamp according to claim 1, wherein said contact surfaces of the terminals are located so as to contact a common plane which extends parallel to the axis of the bulb and is located outside of the base body.

11. A low-pressure discharge lamp according to claim 1, wherein each of said base bodies is shaped like a prism, and said terminals are attached to one side surface of the base body.

12. A low-pressure discharge lamp according to claim 1, wherein each of said base bodies is a hollow member having a semicircular cross section, and said terminals are attached to the flat surface of the base body

13. A low-pressure discharge lamp according to claim 1, wherein said bulb is straight.

14. A low-pressure discharge lamp according to claim 1, wherein said bulb is bent such that the end portions are juxtaposed.

15. A low-pressure discharge lamp according to claim 1, wherein said bulb is U-shaped.

16. A low-pressure discharge lamp according to claim 1, wherein each of said base bodies has two recesses into which engaging means of a socket are to be fitted, the recesses being formed in the periphery of the base body to oppose to each other with interposing the terminals therebetween.

17. A low-pressure discharge lamp comprising:

a bulb having two end portions and electrodes contained in the end portions, respectively; and a pair of bases each having a base body which is attached to one of the end portions of the bulb, the periphery of said base body having a flat surface portion, and a terminal attached to the flat surface portion and having a contact surface extending substantially parallel to the axis of the bulb, said contact surfaces of the terminals are directed in the same direction.

18. A lighting apparatus comprising:

a low-pressure discharge lamp including:

a bulb having two end portions and electrodes contained in the end portions, respectively; and a pair of bases each having a base body which is attached to the end portion of the bulb, the periphery of said base body having a flat surface portion, and a pair of terminals connected to the electrode and attached to the flat surface portion to be arranged side by side, said terminals having contact surfaces which extend substantially parallel to the axis of the bulb, and said base body having an engagement section;

a pair of sockets to which said bases are connected, each of said sockets including:

a base portion;

holding means for engaging the engagement section of the base body to hold the base; and a pair of power-supply terminals mounted on the base portion, and held in contact with the contact surfaces of the terminals attached to the base body while the holding means engages with the engagement section.

19. An apparatus according to claim 18, wherein said engagement section of each base includes a pair of recesses formed in the periphery of the base body so as to oppose each other with the terminals interposed therebetween, and each holding means includes a pair of holding members extending parallel to each other from the base portion and fit in the recesses of the base, respectively.

20. An apparatus according to claim 18, wherein each of said base bodies has an end wall located perpendicular to the axis of the bulb, each of said engagement sections has a recess formed in the end wall, and each holding means includes a holding member extending from the base portion and fitted in the recess.

* * * * *